US009031202B2

(12) United States Patent
Hove et al.

(10) Patent No.: US 9,031,202 B2
(45) Date of Patent: May 12, 2015

(54) ROTARY ANODE FOR A ROTARY ANODE X-RAY TUBE AND METHOD FOR MANUFACTURING A ROTARY ANODE

(75) Inventors: Ulrich Hove, Norderstedt (DE); Zoryana Terletska, Hamburg (DE); Christoph Bathe, Hamburg (DE); Peter Rödhammer, Ehenbichl (AT); Jürgen Schatte, Reutte (AT); Wolfgang Glatz, Reutte (AT); Thomas Müller, Höfen (AT)

(73) Assignee: Plansee SE, Reutte (AT)

( * ) Notice: Subject to any disclaimer, the term of this patent is extended or adjusted under 35 U.S.C. 154(b) by 351 days.

(21) Appl. No.: 13/390,145

(22) PCT Filed: Aug. 10, 2010

(86) PCT No.: PCT/IB2010/053605

§ 371 (c)(1),
(2), (4) Date: Mar. 16, 2012

(87) PCT Pub. No.: WO2011/018750

PCT Pub. Date: Feb. 17, 2011

(65) Prior Publication Data

US 2012/0163549 A1 Jun. 28, 2012

(30) Foreign Application Priority Data

Aug. 11, 2009 (EP) ..... 09167611

(51) Int. Cl.
*H01J 35/10* (2006.01)

(52) U.S. Cl.
CPC ..... *H01J 35/108* (2013.01); *H01J 2235/081* (2013.01); *H01J 2235/085* (2013.01)

(58) Field of Classification Search
USPC ..... 378/144
See application file for complete search history.

(56) References Cited

U.S. PATENT DOCUMENTS 3,158,513 A 11/1964 Janssen et al.
3,610,984 A 10/1971 Seki (Continued)

FOREIGN PATENT DOCUMENTS

DE 10 2005 033 799 A1 8/2006
EP 1 953 254 A1 8/2008

(Continued)

OTHER PUBLICATIONS

Translation for DE 102005033799 A1 published on Aug. 10, 2006.*

(Continued)

*Primary Examiner* — Glen Kao
(74) *Attorney, Agent, or Firm* — Laurence A. Greenberg; Werner H. Stemer; Ralph E. Locher

(57) ABSTRACT

A rotary anode for a rotary anode X-ray tube has an anode disc with a supporting portion. A focal track is located in the vicinity of an outer diameter of the anode disc. The supporting portion has inhomogeneous material properties along a radial coordinate of the anode disc to provide a high mechanical load capacity in the area of an inner diameter of the anode disc and a high thermal load capacity at the focal track. These measures provide for a rotary anode for a rotary anode X-ray tube that meets the extreme thermal and mechanical loads during operation. Further, a method for manufacturing such a rotary anode is described as well.

8 Claims, 5 Drawing Sheets

(56) References Cited

U.S. PATENT DOCUMENTS

| | | | | |
|---|---|---|---|---|
| 3,735,458 | A | 5/1973 | Magendans et al. | |
| 4,958,364 | A | 9/1990 | Guerin et al. | |
| 7,382,864 | B2 | 6/2008 | Hebert et al. | |
| 7,489,763 | B2 | 2/2009 | Lenz | |
| 7,860,220 | B2 | 12/2010 | Aoyama et al. | |
| 8,243,884 | B2 | 8/2012 | Rödhammer et al. | |
| 2004/0247082 | A1 * | 12/2004 | Hoffman | 378/119 |
| 2007/0071174 | A1 | 3/2007 | Hebert et al. | |
| 2009/0290685 | A1 | 11/2009 | Aoyama et al. | |
| 2011/0211676 | A1 | 9/2011 | Dorscheid et al. | |

FOREIGN PATENT DOCUMENTS

| | | | |
|---|---|---|---|
| GB | 1311321 | A | 3/1973 |
| JP | 0198468 | U | 6/1989 |
| JP | 01209640 | A | 8/1989 |
| JP | 2007035634 | A | 2/2007 |
| JP | 2007087943 | A | 4/2007 |
| WO | 2007049761 | A1 | 5/2007 |
| WO | 2009/019645 | A2 | 2/2009 |
| WO | 2009039545 | A1 | 4/2009 |

OTHER PUBLICATIONS

Terletska et al., "Non-Destructive Assessment of the Re-Crystallization State of TZM", Proceedings of the 17. Plansee-Seminar 2009, May 27, 2009, pp. RM62/1-6.

* cited by examiner

ROTARY ANODE FOR A ROTARY ANODE X-RAY TUBE AND METHOD FOR MANUFACTURING A ROTARY ANODE

FIELD OF THE INVENTION

The invention is related to a rotary anode for a rotary anode X-ray tube. The invention is further related to a method for manufacturing a rotary anode for a rotary anode X-ray tube.

BACKGROUND OF THE INVENTION

From U.S. Pat. No. 3,735,458 a double-layer rotary anode and a method for manufacturing such a double-layer rotary anode from a tungsten anode portion and a supporting portion of a cast molybdenum alloy is known.

As a molybdenum alloy for the supporting portion, a material known under the trade name "TZM" is used. Besides molybdenum, this material contains titanium, zirconium and carbon. It is satisfactory workable by temperature and deformation treatments already carried out in the metallurgical factory. The admixtures of titanium and zirconium in the molybdenum lower the melting point so that this material can be cast and the re-crystallization temperature is raised to 1,800° C. Thus the increase in mechanical strength achieved in this manufacture of the rotary anode is maintained even under heavy operational conditions, provided that the temperature of the supporting portion remains below 1,800° C.

According to U.S. Pat. No. 3,735,458, from a rod of this material a disc is formed and smoothed on at least one side by conventional cutting processes.

Further, a disc of tungsten forming the anode portion is manufactured, this disc being smoothed to the optimum at least on one side by grinding and/or polishing so that at the same time a clean surface free of an oxide skin is obtained.

The anode portion and supporting portion discs are then joined by their smooth sides and heated in an oven at a temperature of about 1,650° C. in a non-oxidizing or reducing atmosphere. After heating, the joined anode portion and supporting portion discs are conveyed as quickly as possible, in order to restrict any oxidation and to minimize cooling, to a quick-action impact forming device. In this device, the anode portion and supporting portion discs are pressed together with a high-energy stroke. Thereby, the two discs form an intimate bond at a very high pressure. Since the deformation takes place below the re-crystallization temperature of 1,800° C. of the supporting portion, so that a cold-state deformation is concerned here, the high deformation produced by the impact will provide in addition a high stiffening of the supporting portion.

However, in modern rotary anode X-ray tubes, the rotary anode is subjected to extreme thermal and mechanical loads during operation of the rotary anode X-ray tube. Such, the temperature of the anode disc at the anode portion, especially at a focal track where during operation an electron beam emitted by a cathode is hitting the anode portion, may be extremely high. This may have unwanted impacts on the material of the supporting portion of the anode disc, and especially may lead to unwanted changes of the material properties of the material of the supporting portion of the anode disc.

OBJECTS OF THE INVENTION

It is an object of the present invention to provide a rotary anode for a rotary anode X-ray tube that meets the extreme thermal and mechanical loads during operation. It is further an object of the present invention to provide a method for manufacturing such a rotary anode.

SUMMARY OF THE INVENTION

These objects are accomplished by the invention according to which a rotary anode for a rotary anode X-ray tube is provided, comprising an anode disc with a supporting portion, a focal track being located in the vicinity of an outer diameter of the anode disc, the supporting portion having inhomogeneous material properties along a radial coordinate of the anode disc to provide a high mechanical load capacity in the area of an inner diameter of the anode disc and a thermally stable state, that means a high thermal load capacity, at the focal track, that means in the vicinity of the outer diameter of the anode disc.

Thus, the aforementioned requirements are met by different material properties at the outer edge and at the inner edge of the anode disc, that means in the area of the inner diameter on the one hand and in the vicinity of the outer diameter on the other hand. Underneath the focal track, which is the target area of an electron beam emitted by a cathode during operation of the X-ray tube, the anode disc reaches very high temperatures. There a thermally stable state of the material is required, which is associated with an at least almost completely re-crystallized microstructure with low yield strength. For a strong fixation high yield strength at the inner edge is needed, that is related to a lower degree of re-crystallization. Therefore, in the area of the inner diameter of the anode disc the structural state of the material of the supporting portion should not be changed after the forming process applied to the anode disc.

Preferably, in a rotary anode of this kind the supporting portion is made from a high-melting-point metal or a high-melting-point metal alloy, also named as refractory metal or refractory metal alloy, the metal or metal alloy having a crystalline microstructure varying along the radial coordinate of the anode disc.

According to this embodiment, the variation of the properties of the supporting portion of the anode disc along the radial coordinate is realized by a radial variation of the grain structure, that means by providing different grain structures along the radial coordinate.

In a preferred embodiment of the rotary anode, the metal or metal alloy has a degree of re-crystallization increasing along the radial coordinate of the anode disc.

Preferably, the degree of re-crystallization of the metal or metal alloy is chosen to be at least nearly zero in the area of the inner diameter of the anode disc and at least nearly hundred percent at the focal track, that is in the vicinity of the outer diameter of the anode disc. That means that the metal or metal alloy is not or at least nearly not re-crystallized in the area of the inner diameter of the anode disc after the forming process steps, and is completely or almost completely re-crystallized at the focal track. Especially, the material of the supporting portion shows only few and small grains at the inner diameter of the anode disc and many and large grains at the focal track in the vicinity of the outer diameter of the anode disc.

In another preferred embodiment, the supporting portion of the rotary anode is made from a molybdenum alloy. Preferably, the supporting portion is made from an alloy made of molybdenum and further containing titanium, zirconium and carbon, also known under the trade name "TZM".

Furthermore, the described distribution of material properties is not only applicable for "TZM", but also for other refractory metals or refractory metal alloys like arc-cast-"TZM", "MHC", and others. Arc-cast-"TZM" is "TZM" that has been molten together in an arc furnace. "MHC" is an abbreviation for molybdenum-hafnium-carbide; its properties are similar to those of "TMZ". In general, besides molybdenum refractory metals are vanadium, niobium, tantalum, tungsten, chrome, titanium, zirconium and hafnium, from which molybdenum, tungsten, zirconium, vanadium and niobium are to be preferred for technical and cost reasons. Especially, molybdenum, "TZM", "MHC", several molybdenum-tungsten-alloys, several molybdenum-niobium-alloys, several molybdenum-vanadium-alloys, and several molybdenum-zirconium-alloys are to be preferred, eventually alloys comprising tantalum.

Advantageously, such a rotary anode is, characterized in that at the focal track an anode portion is fixed to the supporting portion. The anode portion mounted on the supporting portion of the anode disc is forming a target area of the rotary anode made for an electron beam being shot onto its surface during operation of the rotary anode X-ray tube and for thereby emitting X-radiation. Preferably, this anode portion is made from a layer of tungsten.

The objects of the invention are further accomplished by a method for manufacturing a rotary anode for a rotary anode X-ray tube, the rotary anode comprising an anode disc with a supporting portion and an anode portion mounted at a focal track on the surface of the supporting portion in the vicinity of its outer diameter, the manufacture at least comprising the steps of forming of the supporting portion from a metal or a metal alloy by a deformation process at a temperature lower than a re-crystallization temperature of the metal or the metal alloy, so as to obtain a material of the supporting portion having a high mechanical load capacity at least in the area of an inner diameter of the anode disc, mounting the anode portion onto the surface of the supporting portion, heating the anode disc selectively in the vicinity of the outer diameter of the supporting portion at a temperature at least as high as the re-crystallization temperature of the material of the supporting portion so as to obtain a material of the supporting portion having a thermally stable state at the focal track, that means a high thermal load capacity in the vicinity of the outer diameter of the anode disc.

After the deformation process, the crystal structure of the material of the supporting portion is "disturbed", resulting in an increase in mechanical load capacity—also denoted as yield strength—compared to that of a material in a (re-) crystallized state showing large and regular grains. However, the deformed crystal structure of the material is not thermally stable, so it might change during operation of the rotary anode in the rotary anode X-ray tube, when the anode portion at the focal track and therefore the material of the supporting portion of the anode disc in the vicinity of the focal track is heated by the electron beam hitting it. By means of the heating step of the manufacture as described, the crystal structure of the material of the supporting portion is selectively transferred into a thermally stable state, that means it is re-crystallized. In order not to decrease the mechanical load capacity of the supporting portion of the anode disc in total, especially not in the area of the inner diameter of the anode disc, where a high mechanical load capacity is essential, only the material in the vicinity of the focal track is re-crystallized, while especially the material in the area of the inner diameter of the anode disc is excepted from the described heating step.

By this means, a crystal structure of the material of the supporting portion being not or at least nearly not re-crystallized in the area of the inner diameter of the anode disc, and being completely or almost completely re-crystallized at the focal track is achieved. Especially, the material of the supporting portion shows only few and small grains at the inner diameter of the anode disc and many and large grains at the focal track in the vicinity of the outer diameter of the anode disc.

The described manufacturing steps lead to an anode disc having a higher mechanical load capacity than an anode disc completely made of re-crystallized material and at the same time a thermally stable state at the outer diameter and such a higher thermal load capacity compared to that of an anode disc completely made of non-re-crystallized material.

In a preferred embodiment of the described manufacturing process, the heating of the anode disc selectively in the vicinity of the outer diameter of the supporting portion is performed after mounting the rotary anode into the rotary anode X-ray tube, by application of an electron beam to the anode disk at the focal track.

To this purpose, an electron beam emitted by a cathode being part of the X-ray tube is used. It is directed to the anode disc at the focal track to heat the supporting portion in this area. By this means, the heating can be performed in a very simple and precise manner exactly to those areas where the re-crystallization process has to be carried out for obtaining the thermal stability of the supporting portion of the anode disc strived for. As this process step will take place after having evacuated the X-ray tube, the anode disc automatically is prevented from thermal oxidation. However, the electron beam usually will have to be of higher intensity than for regular operation of the X-ray tube.

In another preferred embodiment of the described manufacturing process, the heating of the anode disc selectively in the vicinity of the outer diameter of the supporting portion is performed after mounting the rotary anode into a pseudo-rotary-X-ray tube, by application of a thermal load to the supporting portion of the anode disc at the focal track.

The pseudo-rotary-X-ray tube in this context can be understood as a production apparatus similar to an X-ray tube, in which the rotary anode is fixed only during manufacture for fabrication purposes. Thus, the manufacturing steps described are taking place in this production apparatus, and an overload of the construction elements of the X-ray tube during the manufacture is avoided.

In this preferred embodiment, further the heating of the anode disc selectively in the vicinity of the outer diameter of the supporting portion is performed by application of an electron beam to the supporting portion of the anode disc at a backside of the supporting portion opposite to the anode portion at the focal track.

In this embodiment, the heating again is performed by an electron beam; however, the electron beam is now directed to a backside of the supporting portion underneath the focal track. Such, especially an excessive heating of the anode portion at the focal track and consequently an erosion of the material of the anode portion caused by this heating is avoided.

According to another embodiment, a variation of the described method for manufacturing a rotary anode for a rotary anode X-ray tube is provided, the rotary anode according to this variation comprising an anode disc with a supporting portion and an anode portion mounted at a focal track on the surface of the supporting portion in the vicinity of its outer diameter, the manufacture at least comprising the steps of forging of the supporting portion from a metal or a metal alloy with a distribution of the degree of deformation being higher in the area of an inner diameter of the anode disc than in the vicinity of the outer diameter of the supporting portion, heating the anode disc at a uniform temperature for an annealing of the anode disc, so as to obtain a material of the supporting portion having a high mechanical load capacity at least in the area of the inner diameter of the anode disc and a thermally stable state at the focal track, mounting the anode portion onto the surface of the supporting portion.

Such, according to this embodiment, the anode disc is forged disc with a certain distribution of the degree of deformation, that way that the degree of deformation is higher on the inner diameter than on the outer diameter, and a uniform annealing temperature is applied afterwards to the anode disc, for example in a furnace. This leads to a simpler and more cost-saving fabrication process.

In summary, to meet the great demands made by extreme thermal and mechanical loads on an anode disc, different material properties at the outer edge and at the inner edge of the anode disc are advantageous. The anode disc is provided with a certain distribution of a microstructure of the material. That way the material properties are purposely adjusted to the locally different load requirements. As a preferred material, high-melting-point metal or metal alloy is used, especially molybdenum or a molybdenum alloy, e.g. "TZM". The anode disc is made from one single material, so no "layer structure" or "radial structure" of different materials is necessary. That way the material properties are purposely adjusted to the locally different load requirements. The distribution of microstructure and material properties is produced by a certain degree of deformation and a certain annealing process. The degree of deformation has influence on the crystal structure of the material of the anode disc. By choosing a degree of deformation during the fabrication process with a radial variation, the crystal structure of the disc will radially vary. Choosing the temperature and duration of the annealing then leads to different grades of re-crystallization of the material and thus results in different crystal structures in dependence of the radial coordinate of the anode disc. Development and control of the production process is made by means of hardness measurement.

The invention is applicable for every anode disc of a rotary anode X-ray tube. It is of particular advantage in case of high-power rotary anode X-ray tubes with a high power density and a controlled heat flow through the anode disc.

These and other aspects of the invention will be apparent from and elucidated with reference to the embodiments described hereinafter.

BRIEF DESCRIPTION OF THE DRAWINGS

Embodiments of the invention will be described in more detail hereinafter in context with the accompanying drawings, in which.

DETAILED DESCRIPTION OF EMBODIMENTS

Figure 1:
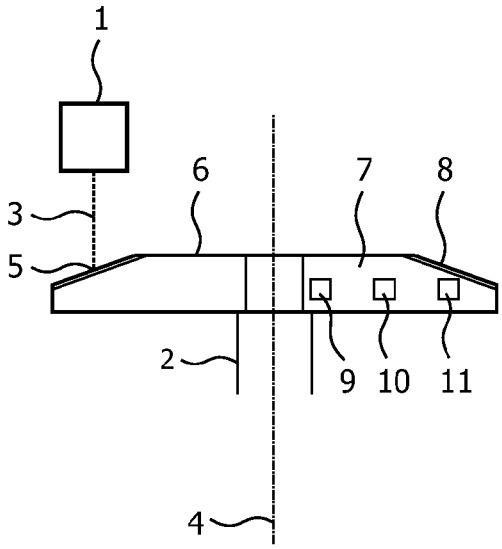
FIG. 1 shows a schematic cross-sectional view of inner construction elements of a rotary anode X-ray tube comprising a cathode and a rotary anode, indicating spots of different microstructure and hardness.

In FIG. 1, a schematic cross-sectional view of some essential inner construction elements of a rotary anode X-ray tube is shown, comprising a cathode 1 and a rotary anode 2. During operation of the rotary anode X-ray tube, an electron beam 3 is emitted from the cathode 1 and directed to the rotary anode 2, which is rotated around an rotational axis 4. The electron beam 3 hits the rotary anode 2 at a focal track 5.

The rotary anode 2 comprises an anode disc 6, which, in turn, comprises a supporting portion 7 made from a molybdenum alloy, for example of the so-called "TZM". In the vicinity of an outer diameter at the focal track 5 of the anode disc 6, an anode portion 8, also denoted as target layer, is mounted to the supporting portion 7.

In FIG. 1, further three spots are marked in the cross-section of the supporting portion 7 of the anode disc 6: a first spot 9 in the area of an inner diameter of the anode disc 6, a second spot 10 at an intermediate point between the inner and an outer diameter of the anode disc 6, and a third spot 11 in the vicinity of the outer diameter of the anode disc 6. The spots 9, 10 and 11 indicate locations of different microstructure and hardness of the material of the supporting portion 7.

Figure 2:
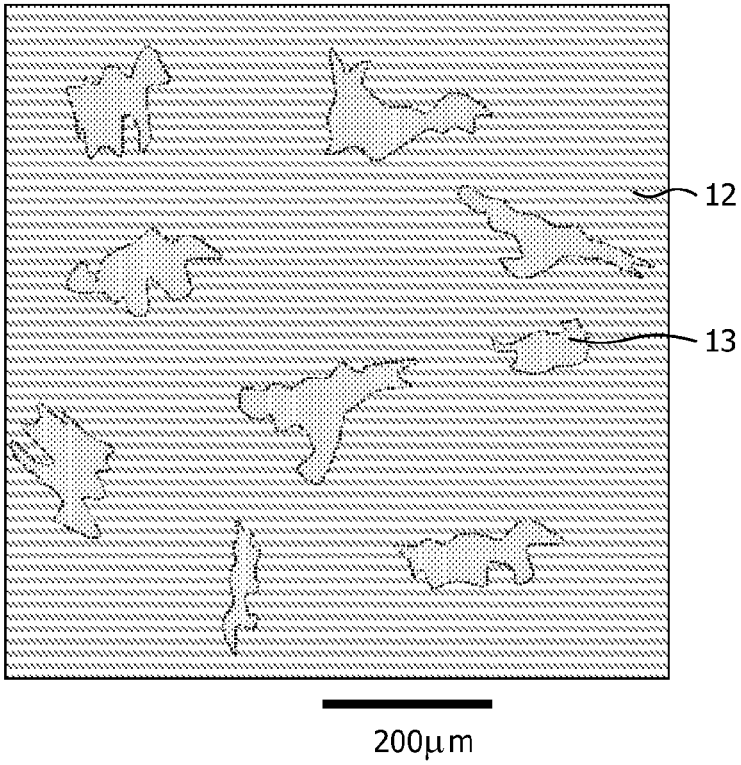
FIG. 2 shows a schematic view of a microstructure of the material of an anode disc according to FIG. 1 at a first spot in the area of an inner diameter of the anode disc.

In FIG. 2, a schematic view of a microstructure of the material of the supporting portion 7 of the anode disc 6 according to FIG. 1 is shown at the first spot 9 located in the area of the inner diameter of the anode disc 6. This microstructure has a first state, which is that immediately after and achieved by a deformation process during manufacturing of the supporting portion 7. The material mostly shows an irregular, "destroyed" or "disturbed" crystal structure, where only remnants of the old crystal borders from the state of the material as it was before deformation, but nearly no grains are visible. This is schematically depicted in FIG. 2 by a uniformly hashed area 12. Throughout this area, that means in this material, like islands initial stages of a new, re-crystallized crystal structure formed by a very cautious annealing, i.e. only little heating of the anode disc, are embedded. This beginning re-crystallization is to be seen in an only very little amount, schematically depicted by spots 13. A ruler having a length of 200 micrometers is shown at the bottom of FIG. 2, from which the scale of this picture can be seen.

Figure 3:
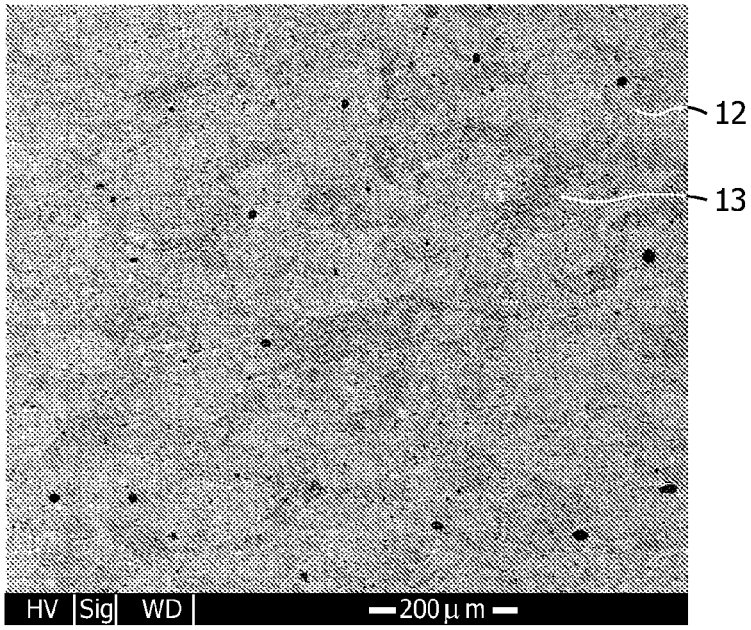
FIG. 3 shows a microscopic photographic view of a microstructure as schematically shown in FIG. 2.

FIG. 3 comprises a microscopic photographic view of a crystal microstructure as schematically shown in FIG. 2. The details of the crystal structure as schematically shown in FIG. 2 are denoted with identical reference numerals. Again, the scale can be seen from a ruler at the bottom of FIG. 3.

Figure 4:
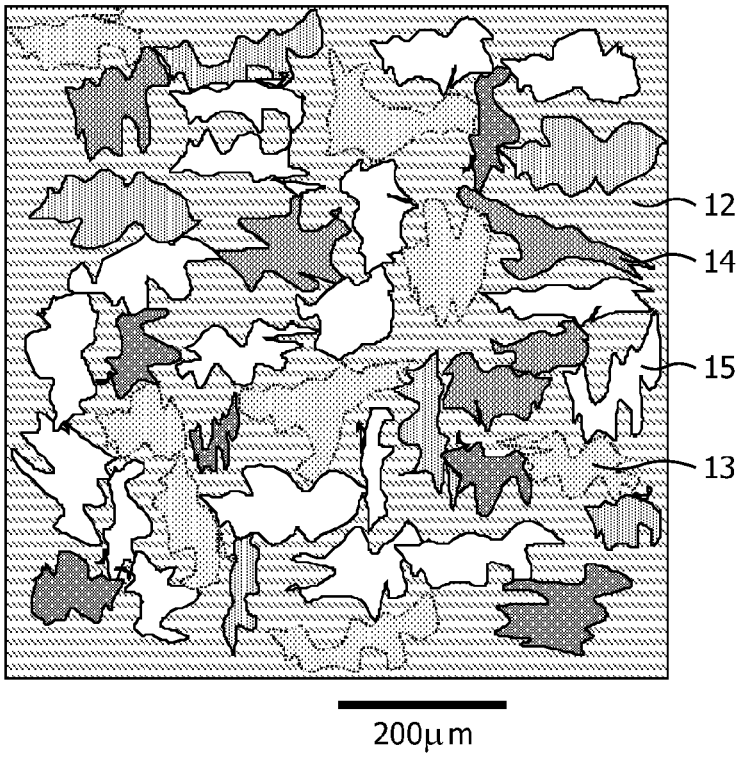
FIG. 4 shows a schematic view of a microstructure of the material of an anode disc according to FIG. 1 at a second spot being located at an intermediate point between the inner and an outer diameter of the anode disc.

In FIG. 4, a schematic view of a microstructure of the material of the supporting portion 7 of the anode disc 6 according to FIG. 1 is shown at the second spot 10 located at an intermediate point between the inner and an outer diameter of the anode disc 6. This microstructure has a second state, which is a more re-crystallized form of the state immediately after and achieved by a deformation process during manufacturing of the supporting portion 7 as shown in FIGS. 2 and 3. The material in this state too still shows many areas where the irregular, "destroyed" or "disturbed" crystal structure still exists, that means where nearly no grains are visible. This is schematically depicted in FIG. 4 by a uniformly hashed area again denoted by reference numeral 12. However, there is an advanced re-crystallization process to be seen in a majority of spots throughout the detail of the supporting portion 7 shown in FIG. 4. Again, there are still areas where only a beginning re-crystallization is to be seen, schematically depicted by spots 13. Other areas, depicted by spots 14 and 15, show spots of advanced re-crystallization with clearly visible and sharply limited grains. The number and intensity of re-crystallized islands, that are new crystals generated by re-crystallization during the annealing process, is increased. A ruler having a length of 200 micrometers is also shown at the bottom of FIG. 4, from which the scale of this picture can be seen.

Figure 5:
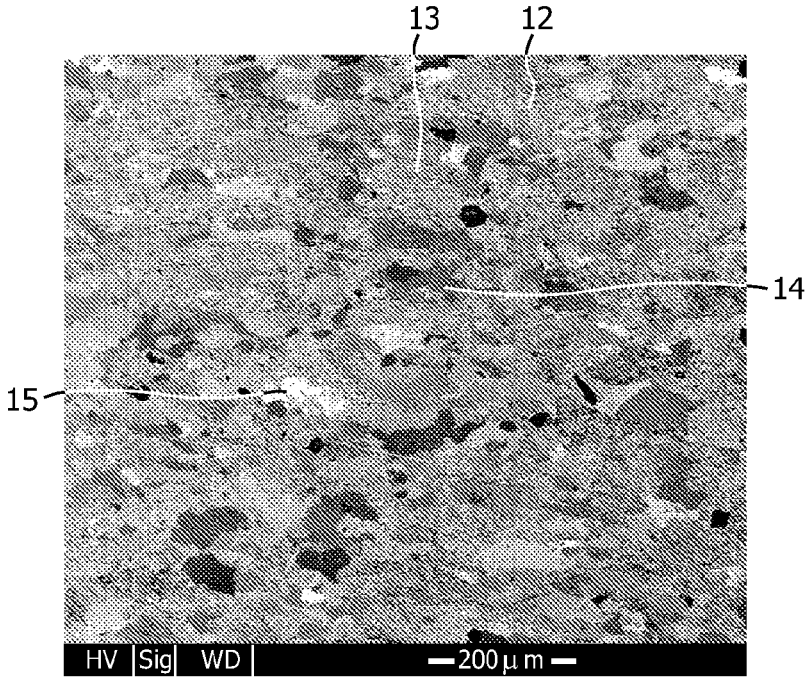
FIG. 5 shows a microscopic photographic view of a microstructure as schematically shown in FIG. 4.

FIG. 5 comprises a microscopic photographic view of a crystal microstructure as schematically shown in FIG. 4. The details of the crystal structure as schematically shown in FIG. 4 are again denoted with identical reference numerals. The scale can be seen from a ruler at the bottom of FIG. 5.

Figure 6:
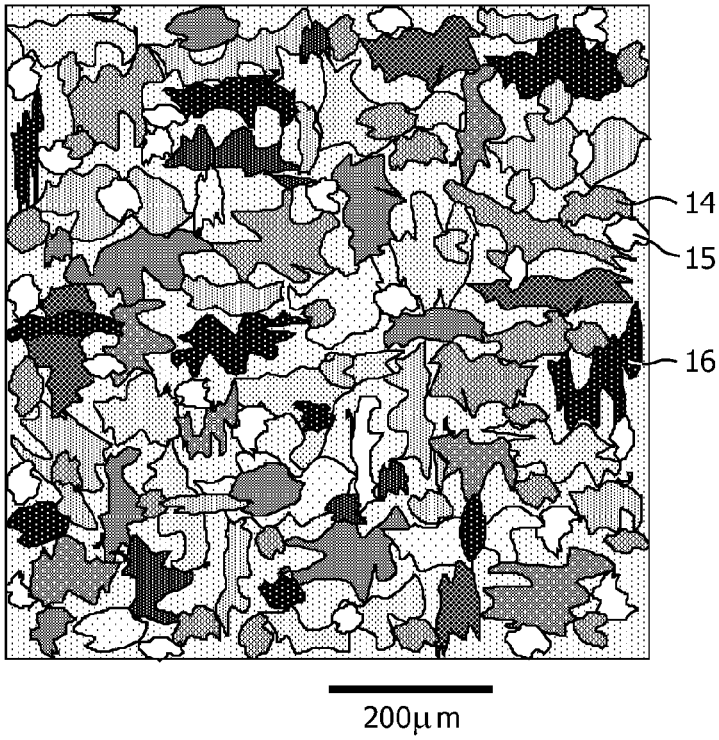
FIG. 6 shows a schematic view of a microstructure of the material of an anode disc according to FIG. 1 at a third spot in the vicinity of the outer diameter of the anode disc.

In FIG. 6, a schematic view of a microstructure of the material of the supporting portion 7 of an anode disc 6 according to FIG. 1 at a third spot in the vicinity of the outer diameter of the anode disc is shown. This microstructure now has a third state, in which the re-crystallization process has at least nearly totally finished. The material in this state neither shows areas where an irregular, "destroyed" or "disturbed" crystal structure exists, nor are there areas where only a beginning re-crystallization is to be seen. That means that throughout the material areas of advanced re-crystallization are to be seen with clearly visible and sharply limited grains, depicted by spots 14, 15 and 16. A ruler having a length of 200 micrometers is also shown at the bottom of FIG. 6, from which the scale of this picture can be seen.

Figure 7:
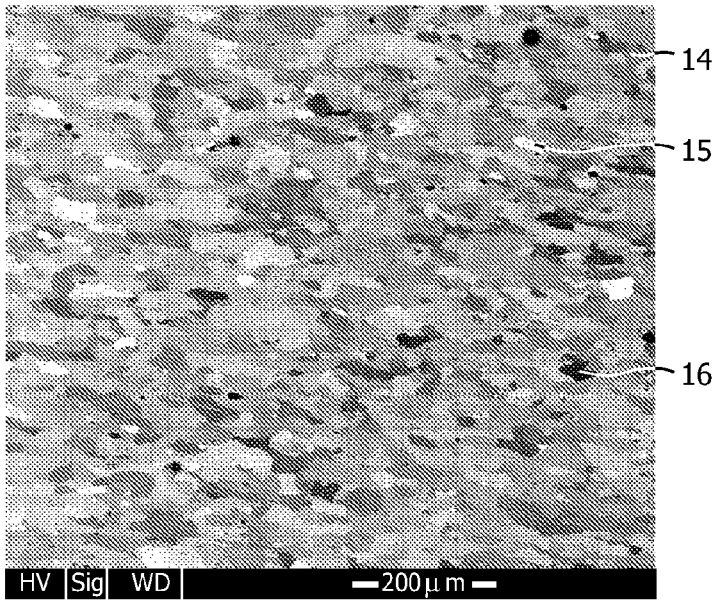
FIG. 7 shows a microscopic photographic view of a microstructure as schematically shown in FIG. 6.

FIG. 7 comprises a microscopic photographic view of a crystal microstructure as schematically shown in FIG. 6. The details of the crystal structure as schematically shown in FIG. 6 are again denoted with identical reference numerals. The scale can be seen from a ruler at the bottom of FIG. 7.

Figure 8:
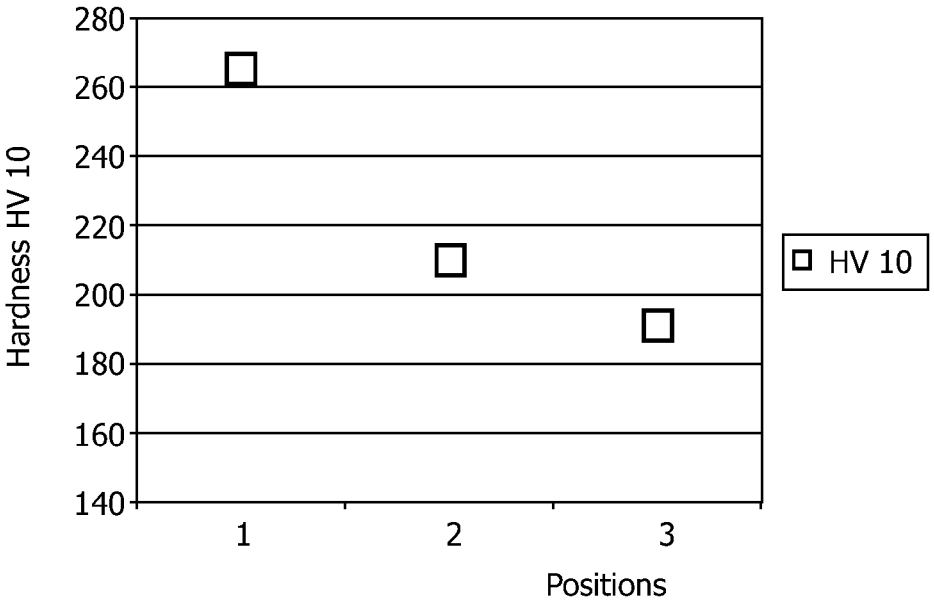
FIG. 8 shows an example for a diagram of the Vickers pyramid hardness at the first, second and third spots according to FIGS. 2 to 7.

In FIG. 8, an example for measured values of the Vickers pyramid hardness at the first, second and third spots 9, 10 and 11 of the supporting portion 7 of the anode disc 6 according to FIGS. 2 to 7 is depicted in a schematic diagram. In this diagram, the spots 9, 10, 11 at which the measured values are taken are indicated as positions, where the first spot 9 corresponds to position 1, the second spot 10 corresponds to position 2, and the third spot 11 corresponds to position 3. The measured values of the Vickers pyramid hardness, abbreviated as HV10, are indicated in the diagram by small quadrats. At the first spot 9, i.e. at position 1, of the material of the supporting portion 7, here a Vickers pyramid hardness HV10 of about 265 is measured. At the second spot 10, i.e. at position 2, of the material of the supporting portion 7, a Vickers pyramid hardness HV10 of about 210 is measured, and at the third spot 11, i.e. at position 3, of the material of the supporting portion 7, a Vickers pyramid hardness HV10 of about 190 is measured.

The measured values of the hardness of the material at the surface of the supporting portion 7 are the same as the values measured within the material, that means in the bulk, straight underneath corresponding measuring points on the surface. Such, the same distribution of hardness as within the bulk material of the supporting portion 7 can be measured on the outside surface of the anode disc 6. That way the distribution of the microstructure and related material properties can be easily controlled by performing a measurement on the surface without the need of cutting the supporting portion 7.

LIST OF REFERENCE NUMERALS

1 cathode of a rotary anode X-ray tube
2 rotary anode of a rotary anode X-ray tube
3 electron beam
4 rotational axis
5 focal track
6 anode disk of rotary anode 2
7 supporting portion of anode disc 6
8 anode portion of anode disc 6
9 first spot in the area of inner diameter of anode disc 6
10 second spot at intermediate point between inner and outer diameter of anode disc 6
11 third spot in the vicinity of outer diameter of anode disc 6
12 uniformly hashed area depicting "destroyed" or "disturbed" crystal structure
13 spots schematically depicting beginning re-crystallization
14 spot of advanced re-crystallization with clearly visible and sharply limited grains
15 spot of advanced re-crystallization with clearly visible and sharply limited grains
16 spot of advanced re-crystallization with clearly visible and sharply limited grains

The invention claimed is:

1. A rotary anode for a rotary anode X-ray tube, comprising:

an anode disc having a supporting portion made from molybdenum or a molybdenum alloy and an anode portion mounted at a focal track on a surface of said supporting portion in a vicinity of an outer diameter thereof;

the molybdenum or the molybdenum alloy of said supporting portion having a degree of re-crystallization that increases along a radial coordinate of said anode disc for providing a relatively higher mechanical load capacity in an area of an inner diameter of said anode disc and for providing a thermally stable state at said focal track; and wherein a crystal structure of the molybdenum or molybdenum alloy of said supporting portion is not re-crystallized, or substantially not re-crystallized, in the area of the inner diameter of said anode disc and is completely or substantially completely re-crystallized at the focal track.

2. The rotary anode according to claim 1, wherein said degree of re-crystallization of the molybdenum or the molybdenum alloy is at least nearly zero in the area of the inner diameter of said anode disc and at least nearly one hundred percent at said focal track.

3. The rotary anode according to claim 1, wherein said supporting portion is made from a molybdenum alloy.

4. A method of manufacturing a rotary anode for a rotary anode X-ray tube, the rotary anode having an anode disc with a supporting portion made from molybdenum or a molybdenum alloy and with an anode portion mounted at a focal track on a surface of the supporting portion in a vicinity of an outer perimeter of the anode disc, the method which comprises:

forming the supporting portion from molybdenum or a molybdenum alloy by a deformation process at a temperature that is lower than a re-crystallization temperature of the molybdenum or molybdenum alloy, mounting the anode portion onto the surface of the supporting portion;

heating the anode disc selectively in the vicinity of the outer periphery of the supporting portion at a temperature at least as high as the re-crystallization temperature of the material of the supporting portion so as to obtain a material of the supporting portion having a degree of re-crystallization increasing along the radial coordinate of the anode disc, with a crystal structure of the molybdenum or molybdenum alloy of the supporting portion being not re-crystallized or substantially not re-crystallized in an area of an inner diameter of the anode disc and completely, or substantially completely, re-crystallized at the focal track, to obtain a material of the supporting portion having a relatively higher mechanical load capacity at least in the area of the inner diameter of the anode disc and a thermally stable state at the focal track.

5. The method according to claim 4, which comprises performing the step of heating the anode disc selectively in the vicinity of the outer periphery of the supporting portion after a step of mounting the rotary anode into the rotary anode X-ray tube, by applying an electron beam to the anode disk at the focal track.

6. The method according to claim 4, wherein the step of heating the anode disc selectively in the vicinity of the outer periphery of the supporting portion comprises subjecting the supporting portion of the anode disc at the focal track to a thermal load following a mounting of the rotary anode into a pseudo-rotary-X-ray tube.

7. The method according to claim 4, wherein the step of heating the anode disc selectively in the vicinity of the outer diameter of the supporting portion comprises applying an electron beam to the supporting portion of the anode disc at a backside of the supporting portion opposite the anode portion at the focal track.

8. A method for manufacturing a rotary anode for a rotary anode X-ray tube, the rotary anode having an anode disc with a supporting portion made from molybdenum or molybdenum alloy and with an anode portion mounted at a focal track on a surface of the supporting portion in a vicinity of an outer perimeter of the anode disc, the method which comprises:

forging the supporting portion from the molybdenum or the molybdenum alloy, with a degree of deformation being lower in an area of an inner diameter of the anode disc and being higher in a vicinity of an outer perimeter of the anode disc;

heating the anode disc at a uniform temperature for annealing the anode disc, so as to obtain a material of the supporting portion having a degree of re-crystallization that increases along the radial coordinate of the anode disc with a crystal structure of the molybdenum or molybdenum alloy of the supporting portion being not re-crystallized, or substantially not re-crystallized, in an area of an inner diameter of the anode disc and completely, or substantially completely, re-crystallized at the focal track, to obtain a material of the supporting portion having a relatively higher mechanical load capacity at least in the area of the inner diameter of the anode disc and a thermally stable state at the focal track; and mounting the anode portion onto the surface of the supporting portion.

* * * * *